US006190472B1

(12) United States Patent
Lund et al.

(10) Patent No.: US 6,190,472 B1
(45) Date of Patent: Feb. 20, 2001

(54) METHOD OF SOFT ANNEALING HIGH CARBON STEEL

(75) Inventors: Thore Lund; Staffan Larsson; Patrik Ölund, all of Hofors (SE)

(73) Assignee: Ovako Steel AB, Hofors (SE)

( * ) Notice: Under 35 U.S.C. 154(b), the term of this patent shall be extended for 0 days.

(21) Appl. No.: 09/268,669

(22) Filed: Mar. 16, 1999

(30) Foreign Application Priority Data

Mar. 16, 1993 (SE) ..... 9800860

(51) Int. Cl.[7] ..... C21D 9/08; C21D 8/00; C21D 6/00

(52) U.S. Cl. ..... 148/593; 148/654; 148/662; 148/664

(58) Field of Search ..... 148/593, 654, 148/662, 664

(56) References Cited

U.S. PATENT DOCUMENTS

| | | | | |
|---|---|---|---|---|
| Re. 27,505 | * | 10/1972 | Grange et al. | 148/143 |
| 3,178,324 | * | 4/1965 | Grange et al. | 148/143 |
| 3,432,368 | * | 3/1969 | Nakamura | 148/12 |
| 3,762,964 | * | 10/1973 | Kranenberg . | |
| 4,030,944 | * | 6/1977 | Sommer et al. . | |
| 4,067,756 | * | 1/1978 | Koo et al. | 148/144 |
| 4,971,634 | * | 11/1990 | Shibata et al. . | |
| 5,653,826 | * | 8/1997 | Koo et al. | 148/328 |
| 5,827,379 | * | 10/1998 | Okamura et al. | 148/621 |
| 5,830,285 | * | 11/1998 | Katayama et al. | 148/320 |
| 5,900,075 | * | 5/1999 | Koo et al. | 148/328 |
| 5,958,158 | * | 9/1999 | Kron et al. | 148/598 |

FOREIGN PATENT DOCUMENTS

| | | | |
|---|---|---|---|
| 0 098 344 | * | 1/1984 | (EP) . |
| 4103715 | | 4/1992 | (JP) . |
| WO83/04267 | * | 12/1983 | (WO) . |

OTHER PUBLICATIONS

Patents Abstracts of Japan, Publication No. 01234519, Sep. 19, 1989.*

A.T. Bykadorov, "Spheroidizing of rolled sections of 20G2R steel," Oct. 1984, pp. 446–448, XP002106012.*

E. Doluhnkov et al., "Effect of Preliminary Quenching of Spheroidization of Carbides," *Metal Science and Heat Treatment,* vol. 17, No. 3/4, 1975, pp. 211–213, XP002106013.*

* cited by examiner

*Primary Examiner*—Daniel J. Jenkins
*Assistant Examiner*—Nicole Coy
(74) *Attorney, Agent, or Firm*—Burns, Doane, Swecker & Mathis, L.L.P.

(57) ABSTRACT

A method for soft annealing of high carbon steel, characterized by taking objects to be soft annealed directly from a hot forming step and cooling to below Al–20° C.;

heating the objects to Al+20° C. or above, and then cooling the objects down to beneath the Al temperature of the steel quickly as in air, which step is performed at least once;

heating the objects to Al+20° C. or above, cooling the objects down to about 740° C., and then cooling the objects down to about 690° C. at a cooling rate of 3.5° C./min. or lower; and finally cooling the objects down to ambient temperature.

6 Claims, 1 Drawing Sheet

Temperature vs. Time graph illustrating a possible soft annealing method according to the invention

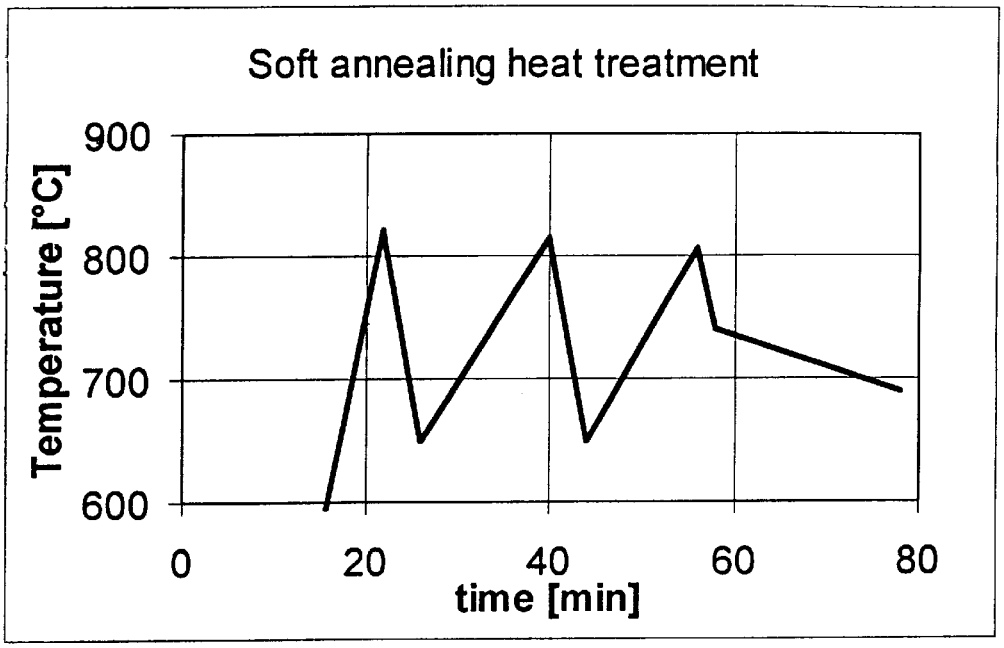
*Figure 1* Temperature vs. Time graph illustrating a possible soft annealing method according to the invention

METHOD OF SOFT ANNEALING HIGH CARBON STEEL

BACKGROUND OF THE INVENTION

The present invention relates to a method for soft annealing of high carbon steel.

Soft annealing normally takes 12 to 48 hours time and is performed either batchwise or continuously in an oven. The load in the oven is then heated to about 800° C. which takes between 2 and 10 hours, the temperature is maintained for about 2 hours, the temperature is then quickly brought down to about 790° C. and then down to about 690° C. at a rate of about 10° C. per hour.

This procedure is very time consuming, costly and may result in decarburization.

Further, because of different conditions at different locations in the oven, the structure will vary substantially between the objects, and also within one and the same object. A test of a batch of tubes of standard steel, SAE52100, showed that the hardness varied between 170 and 220 HB, depending on where in the oven the respective tube was placed.

When soft annealing a batch of tubes, one tube can be subjected to different conditions over its length, resulting in thermal stresses, and in a considerable distortion at the subsequent hardening.

There is a great need of reducing the costs involved in the soft annealing process for high carbon steel. However, the structure of steel after the soft annealing process is of critical importance for subsequent procedures and for the intended use. Many attempts have been made to develop the soft annealing procedure in different aspects.

According to JP04103715-A (Sumitomo Metals Ind.) high carbon chrornium bearing steel is subjected to spheroidizing treatment; first by heating to 780–820° C. and cooling to below Arlb point at less than 200° C./hr and by heating to Aclb-(Aclb+40)° C., cooling to below Arlb at less than 200° C./hr, heating to Aclb-(Aclb+40)° C. and cooling to below Arlb at less than 75° C./hr. This publication deals mainly with the structure of the steel, and does not teach how to solve the problems discussed above.

OBJECTS AND SUMMARY OF THE INVENTION

It is an object of this invention to avoid or alleviate the problems of the prior art.

It is further an object of this invention to provide a method for soft annealing of objects made of a high carbon steel with which the above mentioned drawbacks are eliminated.

More specifically, one object of the invention is to shorten the process time and to make possible an in-line operation, while obtaining a very small decarburization.

Another object is to provide a method for soft annealing high carbon steel which gives little or no pearlite at the surface, and which results in fewer and smaller carbides at the surface, and a smaller structural gradient.

Yet another object is to provide a method of soft annealing which can be performed in-line, and wherein the objects are exposed to identical conditions, and thereby an unitary structure and unitary characteristics are obtained.

It is an aspect of this invention to provide a method for soft annealing high carbon steel articles comprising:

hot forming an article of high carbon steel;

cooling the hot formed article to a temperature at least 20° C. below the Al temperature;

heating the cooled article to a temperature at least 20° C. above the Al temperature;

quickly cooling the heated article below the Al temperature;

heating the cooled article to a temperature at least 20° C. above the Al temperature;

cooling the heated article to about 740° C.;

cooling the said article down to about 690° C. at a cooling rate of a maximum of 3.5° C./min; and cooling to ambient temperature.

BRIEF DESCRIPTION OF THE DRAWINGS

The invention will now be described more in detail with references to the appended drawings, in which The FIGURE is a graph showing temperature vs. time illustrating a possible soft annealing method according to the invention.

DETAILED DESCRIPTION OF THE PREFERRED EMBODIMENTS OF THE INVENTION

In total, this process takes about 1.5 hours. The objects are taken directly from the hot forming step, and are transferred separately in-line into a soft annealing oven. The oven can be divided into a number of chambers, with intermediate spaces in which the air cooling takes place, possibly enhanced by sprinkling water onto the objects.

The method is fast, continuous and can be performed in-line. The conventional transport and logistic problems are eliminated.

Other differences between the process of the present invention and that of conventional processes are that one heating cycle from ambient temperature to 650° C. disappears, as well as heating at 820° C. for 2 hours. In addition, less decarburization takes place and smaller structural variations between annealed products and within one product results.

With the method according to the invention, only a small part of the carbides are dissolved each time, resulting in less carbon in solution which can diffuse in the steel.

Other very important advantages are obtained using the method according to the invention. A substantial amount of energy is saved by using the hot forming heat in the subsequent soft annealing step. Further, the in-line system reduces the required oven capacity several times and it is less labor intensive.

According to one embodiment of the invention, the oven configuration consists of a number of parts corresponding to the number of heating and cooling cycles of the process, arranged one after the other with intermediate empty spaces, in which air cooling, possibly forced air cooling using water sprinkling, takes place and wherein the tubes are transported with their longitudinal direction perpendicularly to the longitudinal direction of the oven, i.e., the direction of movement, and preferably using carriers rolling the tubes through the oven. This eliminates the need of a separate straightening step for the tubes after the soft-annealing.

Al as used herein upon heating means the temperature when the matrix phase transforms into austenite. Al upon cooling means the temperature when the austenite phase will transform into other products. The Al temperature for any particular steel can be determined using conventional techniques available to the skilled artisan. Quick cooling as used herein means the cooling rate achieved when cooling in air (typically 0.5° C./min).

The invention is additionally illustrated in connection with the following Example which is to be considered as illustrative of the present invention. It should be understood, however, that the invention is not limited to the specific details of the Example.

Example

A possible soft annealing heat treatment cycle is shown in The FIGURE. The hot rolled SAE52100 steel component was heated in a furnace as quickly as possible to a temperature above Al+20° C., in this case, 820° C. When it reached this temperature it was brought out in air and cooled to a temperature below Al−20° C., in this case 650° C. The component was again heated to a temperature above Al+20° C. (810° C.) and brought out in air to cool. Finally, the component was heated to a temperature above Al+20° C. (800° C.). After this, it was transported into a temperature zone in the furnace having a lower temperature for controlled cooling. The temperature was lowered relatively quickly to 740° C. using fans in the furnace. After this, the cooling from 740° to 690° C. was made in 20 minutes.

The Table shows the structure classified according to the German standard SEP 1520 and hardness. Most material users accept these values.

TABLE

| SEP 1520 and hardness | | | |
|---|---|---|---|
| CG | PA | CN | Brinell Hardness |
| 2.1 | 3.0 | 4.0 | 199 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method for soft annealing high carbon steel articles comprising:

hot forming an article of high carbon steel;

cooling the hot formed article to a temperature at least 20° C. below the temperature;

heating the cooled article to a temperature at least 20 C. above the Al temperature;

quickly cooling the heated article below the Al temperature;

heating the cooled article to a temperature at least 20° C. above the Al temperature;

cooling the heated article to about 740° C. at a first cooling rate;

then cooling the said article down from about 740° C. to about 690 ° C. at a second cooling rate of a maximum of 3.5° C./min; and cooling to ambient temperature.

2. The method of claim 1 wherein the steps of heating the cooled article to a temperature at least 20° C. above the Al temperature and quickly cooling the heated article below the Al temperature is performed at least twice.

3. The method of claim 1, wherein all steps of the method are performed in a total processing time of about 1.5 hours.

4. The method of claim 1, wherein the articles comprise tubes.

5. The method of claim 4, further comprising processing the tubes in an oven with a longitudinal axis of the tubes perpendicular with a longitudinal axis of the oven.

6. The method of claim 1, wherein the step of quickly cooling the heated article comprises cooling at a rate such that perlite is formed and no spheroidization occurs.

* * * * *

UNITED STATES PATENT AND TRADEMARK OFFICE

CERTIFICATE OF CORRECTION

PATENT NO. : 6,190,472 B1
DATED : February 20, 2001
INVENTOR(S) : Thore Lund, Staffan Larssson and Patrik Ölund It is certified that error appears in the above-identified patent and that said Letters Patent is hereby corrected as shown below:

(30) Foreign Application Priority Data:

Please delete "Mar. 16. 1993" and insert therefor -- Mar 16, 1998 --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*